US011300916B2

(12) United States Patent
Suzuki et al.

(10) Patent No.: US 11,300,916 B2
(45) Date of Patent: Apr. 12, 2022

(54) PRINTING APPARATUS AND METHOD FOR CONTROLLING PRINTING APPARATUS

(71) Applicant: CANON KABUSHIKI KAISHA, Tokyo (JP)

(72) Inventors: Takeshi Suzuki, Inagi (JP); Hideyuki Terashima, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 147 days.

(21) Appl. No.: 16/294,220

(22) Filed: Mar. 6, 2019

(65) Prior Publication Data

US 2019/0302673 A1 Oct. 3, 2019

(30) Foreign Application Priority Data

Mar. 30, 2018 (JP) ..... JP2018-068250

(51) Int. Cl.
*B41J 29/38* (2006.01)
*G03G 15/00* (2006.01)

(52) U.S. Cl.
CPC ..... *G03G 15/6561* (2013.01)

(58) Field of Classification Search
None
See application file for complete search history.

(56) References Cited

U.S. PATENT DOCUMENTS

2003/0164955 A1* 9/2003 Vinas ..... B41J 11/008 358/1.2
2014/0152735 A1* 6/2014 Yorimoto ..... B41J 11/0095 347/19
2015/0002864 A1* 1/2015 Yamamoto ..... G06F 3/1208 358/1.2
2016/0101954 A1* 4/2016 Takahashi ..... B65H 7/02 271/265.03
2016/0205281 A1* 7/2016 Narita ..... G06F 3/1235 399/82

FOREIGN PATENT DOCUMENTS

JP H07-276750 A 10/1995
JP 2008-001052 A 1/2008
JP 201752148 A 3/2017
JP 2017-154889 A 9/2017

* cited by examiner

*Primary Examiner* — Erica S Lin
*Assistant Examiner* — Tracey M McMillion
(74) *Attorney, Agent, or Firm* — Canon U.S.A., Inc. I.P. Division

(57) ABSTRACT

A printing apparatus for printing an image on paper includes first and second units, and a registration unit. The first unit detects a first length, along a predetermined conveyance direction, of paper conveyed from a feed port. The second unit detects a second length, along a direction intersecting with the predetermined conveyance direction, of the paper set in the feed port. The registration unit registers a size corresponding to the first and the second lengths of the paper set in the feed port, based on second unit detection. The first unit detects the first length of first paper conveyed to print a predetermined test pattern before second paper is set in the feed port. The registration unit registers a regular size based on a result of first unit detection on the first paper from among regular sizes corresponding to a result of second unit detection on the second paper.

11 Claims, 8 Drawing Sheets

PRINTING APPARATUS AND METHOD FOR CONTROLLING PRINTING APPARATUS

BACKGROUND OF THE INVENTION

Field of the Invention

The present disclosure relates to a printing apparatus for registering the size of paper set in a paper feed port.

Description of the Related Art

A certain operating system (OS) operating on a terminal apparatus supports a printing system included in the OS as standard based on a communication protocol for allowing printing without using a printer driver provided for a printing apparatus. Examples of communication protocols include Internet Printing Protocol (IPP) and Web Services on Devices (WSD). In the above-described printing system included in the OS as standard, paper information about paper set in each paper feed port of the printing apparatus may be displayed on a terminal apparatus. More specifically, a user registers a paper size for each of paper feed ports such as an auto sheet feeder (ASF) and cassettes provided in the printing apparatus. Before a print job is transmitted from the terminal apparatus, paper information including the paper sizes registered as described above is transmitted from the printing apparatus to the terminal apparatus.

Japanese Patent Application Laid-Open No. 2017-52148 discusses a technique for displaying, when a paper cassette is pulled out, a screen for allowing a user to change the paper size to be registered for the paper cassette.

In the technique discussed in Japanese Patent Application Laid-Open No. 2017-52148, the user needs to grasp the size of the paper set in the paper cassette and specify the paper size to register or change the paper size. In view of this, a sensor in the paper feed port may be provided and the paper size of the paper set in the paper feed port may be automatically and uniquely identified. However, since providing such a sensor leads to a cost increase, a simpler sensor may be provided. In such a case, even if the paper set in the paper feed port is detected by using the sensor, the size of the paper may not be uniquely identified.

SUMMARY OF THE INVENTION

The present disclosure has been devised to address the above-described issue, and is directed to offering a technique for allowing a user to, even if a result of detecting paper set in a paper feed port corresponds to a plurality of sizes, suitably register the paper size of the paper.

According to an aspect of the present disclosure, a printing apparatus for printing an image on paper set in a paper feed port includes a conveyance unit configured to convey the paper set in the paper feed port in a predetermined conveyance direction, a first detection unit configured to detect a first length, along the predetermined conveyance direction, of the paper conveyed by the conveyance unit, a second detection unit configured to detect a second length, along a direction intersecting with the predetermined conveyance direction, of the paper set in the paper feed port, and a registration unit configured to register a size corresponding to the first and the second lengths of the paper set in the paper feed port, based on detection by the second detection unit, wherein the first detection unit detects the first length, in the predetermined conveyance direction, of first paper conveyed by the conveyance unit to print a predetermined test pattern before second paper is set in the paper feed port, and wherein the registration unit registers a regular size based on a result of detection on the first paper by the first detection unit from among a plurality of regular sizes corresponding to a result of detection on the second paper by the second detection unit.

Further features of the present disclosure will become apparent from the following description of embodiments with reference to the attached drawings.

DESCRIPTION OF THE EMBODIMENTS

An embodiment of the present disclosure will be illustratively described in detail below with reference to the accompanying drawings. However, the present disclosure is not limited to relative arrangements of elements and display screens described in the present embodiment.

Figure 1:
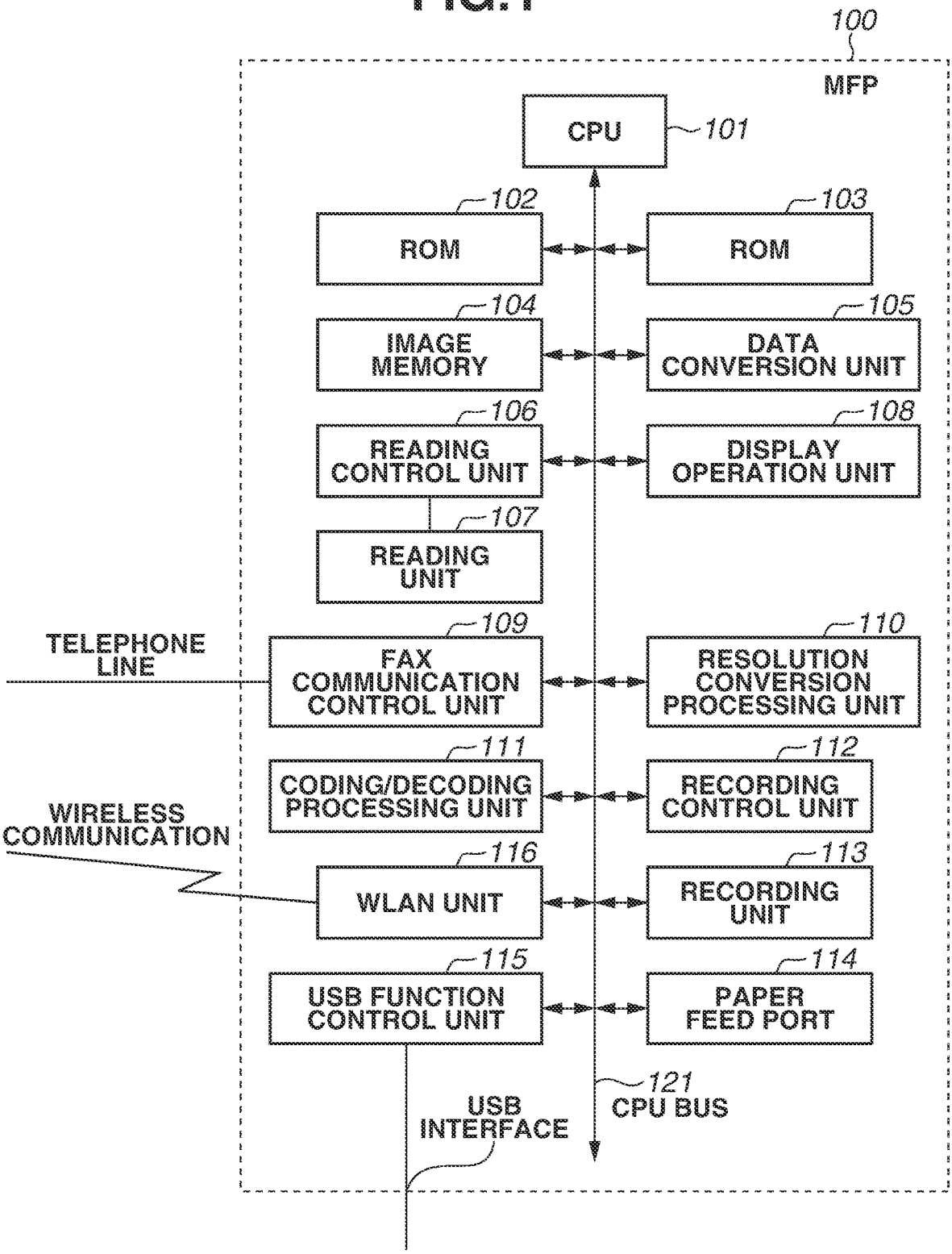
FIG. 1 is a function block diagram illustrating an overall configuration of a multifunction peripheral (MFP) according to a present embodiment.

FIG. 1 is a block diagram illustrating an overall configuration of a multifunction peripheral (MFP) 100 according to the present embodiment. In the MFP 100, a central processing unit (CPU) 101 serves as a system control unit for controlling the entire MFP 100. A read only memory (ROM) 102 stores fixed data including control programs to be executed by the CPU 101, data tables, and embedded operating system (OS) programs. According to the present embodiment, each control program stored in the ROM 102 performs software execution control including scheduling, task switching, and interruption processing under the management of the embedded OS stored in the ROM 102. A random access memory (RAM) 103 includes a static random access memory (SRAM) requiring a backup power source. Data is retained by a primary battery (not illustrated) to back up data. The RAM 103 stores data such as program control variables not to be erased even after power of the MFP 100 is turned OFF. The RAM 103 also includes memory areas for storing user-registered setting values, "Information about delivery time" (described below), and management data of the MFP 100. The RAM 103 also includes memory areas for storing "Paper size identification information" (three paper sizes: UNSET, A4, Letter) and "Paper size information for paper feed port 114" (described below).

Figure 2:
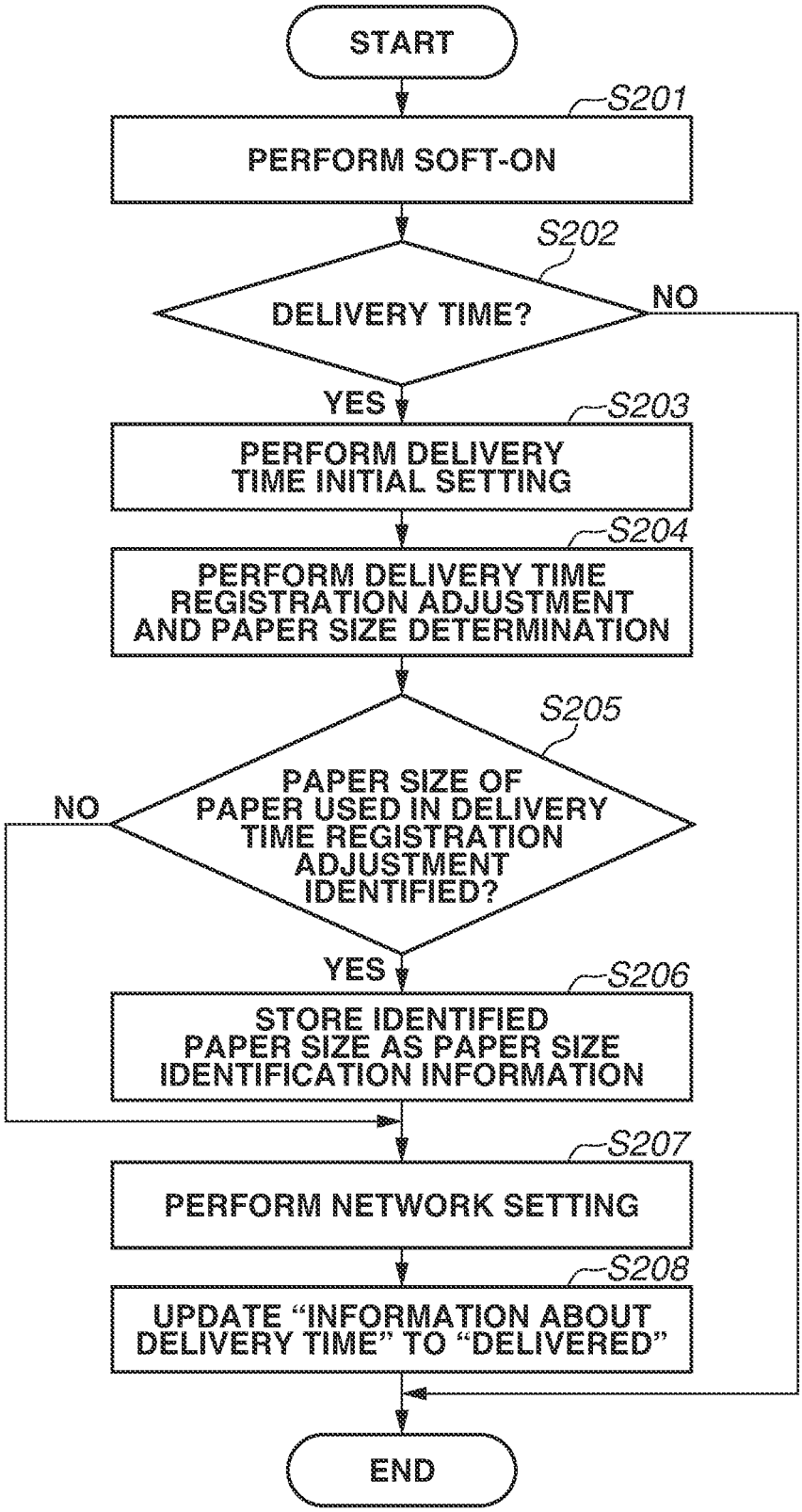
FIG. 2 is a flowchart illustrating a flow of processing to be performed when the MFP according to the present embodiment is activated.
Figure 3:
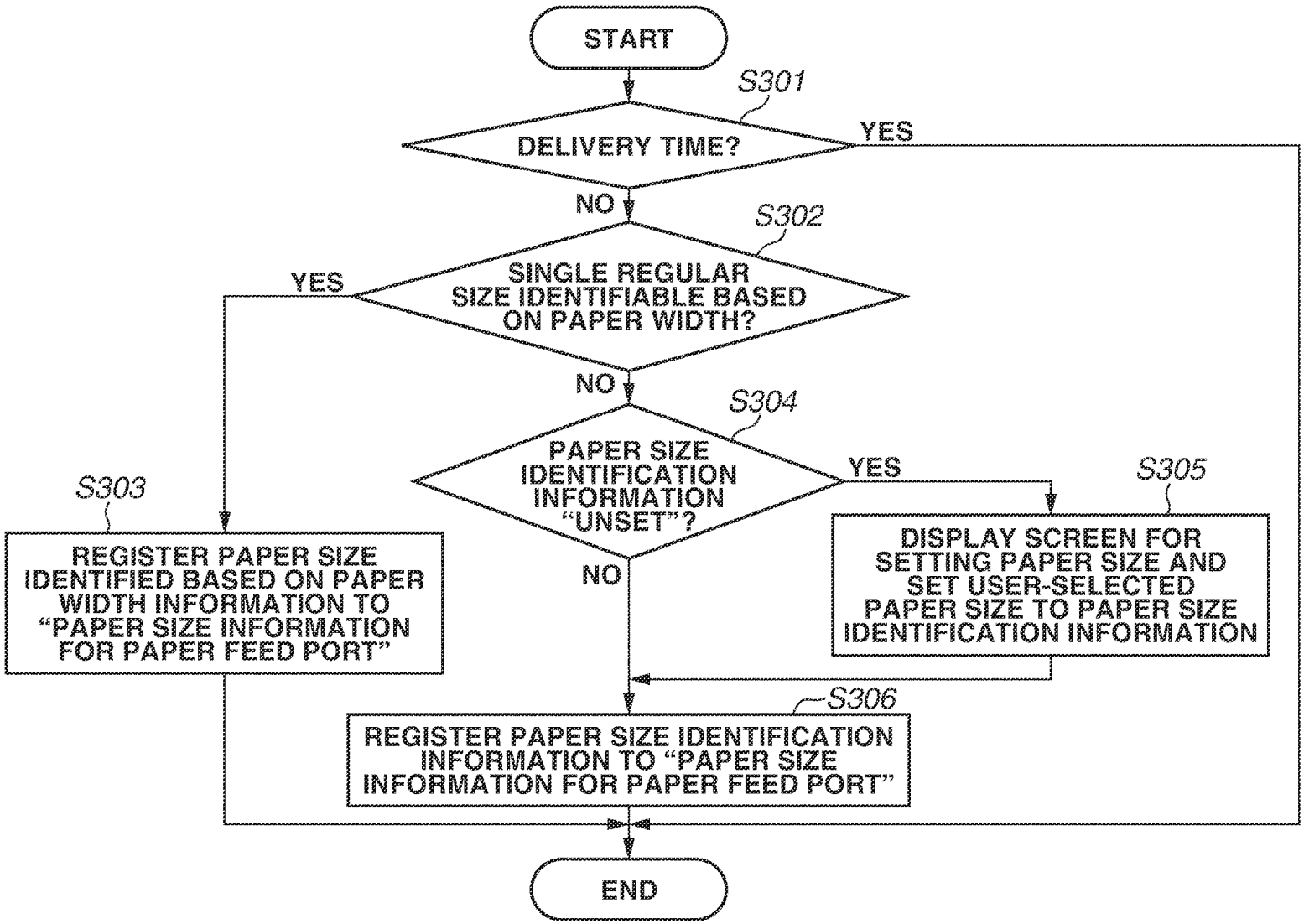
FIG. 3 is a flowchart illustrating a flow of processing to be performed when paper is set in the MFP according to the present embodiment.

An image memory 104 includes a dynamic random access memory (DRAM) for accumulating image data. Some areas are allocated as a work area for execution of software processing. A program corresponding to steps of the flowcharts illustrated in FIGS. 2 and 3 (described below) are stored in the ROM 102. The processing illustrated in FIGS. 2 and 3 is implemented when the CPU 101 reads this program from the ROM 102 into the image memory 104 as a work memory and then executes the program.

A data conversion unit 105 performs image data conversion including page description language (PDL) analysis and character data rasterization in computer graphics (CG). A reading control unit 106 controls a reading unit 107 to optically read a document by using a contact image sensor (CIS), converts an image signal into electrical image data, performs various image processing such as binarization processing and intermediate color processing on the image data via an image processing control unit (not illustrated), and outputs high-definition image data. The reading control unit 106 and the reading unit 107 can employ the following two control methods. A first control method is a sheet reading control method for reading a document by using a fixed CIS image sensor while conveying the document. A second control system is a book reading control method for scanning a document fixed to a document positioning plate by using a moving CIS image sensor.

A display operation unit 108 is provided with numerical input keys, a mode setting key, an application key, a cancellation key, light emitting diodes (LEDs), and a liquid crystal display (LCD). The display operation unit 108 allows a user to activate various multifunction peripheral functions and make various settings. A paper size registration screen 401 (described below) is also displayed on a display provided on the display operation unit 108.

A fax communication control unit 109 connected with a telephone line transmits and receives fax images to/from a fax machine (not illustrated). A resolution conversion processing unit 110 performs resolution conversion control such as conversion from millimeter-based image data to inch-based image data and vice versa. The resolution conversion processing unit 110 also performs enlargement/reduction processing on image data. A coding/decoding processing unit 111 performs coding/decoding processing and enlargement/reduction processing on image data (non-compression, Modified Huffman (MH), Modified Read (MR), Modified Modified Read (MMR), Joint Bi-level Image Experts Group (JBIG), and Joint Photographic Experts Group (JPEG)) to be processed by the MFP 100.

A recording control unit 112 performs smoothing processing, recording density correction processing, color correction, and other various image processing on image data to be printed via an image processing control unit (not illustrated) to convert the image data to be printed into high-definition image data and outputs the high-definition image data to a recording unit 113. The recording unit 113, a recording unit of a laser beam printer or an ink jet printer, prints color image data or monochrome image data generated by the recording control unit 112 onto a printing material fed from the paper feed port 114. The recording unit 113 includes a conveyance mechanism for conveying paper set in the paper feed port 114 in a predetermined direction and performs printing on the paper conveyed. The conveyance mechanism will be described in detail below with reference to FIG. 5.

The paper feed port 114 includes one or more paper feed ports such as an auto sheet feeder (ASF) and paper cassettes. Paper of different sizes can be set in paper feed ports. For example, the MFP 100 according to the present embodiment has one ASF which supports three different paper sizes: a B5 size, an A4 size, and a letter size.

The ASF is provided with a sensor (not illustrated) for detecting a width of paper. The width of paper according to the present embodiment refers to a length of paper in the direction perpendicular to or intersecting with the paper conveyance direction. The ASF is provided with a sensor for detecting a position of a slider on the ASF. To prevent skew during paper conveyance, it is recommended that the user changes the slider position to both ends or one end of paper when setting the paper. Therefore, the width of paper can be detected by setting the slider position detected by the above-described sensor to an edge position of paper. However, the sensor according to the present embodiment is not limited thereto. For example, the ASF is provided with a plurality of sensors arranged in the paper width direction. In this configuration, each sensor detects whether paper is present at the position of each sensor. The width of paper can be detected based on the positions of the plurality of sensors which has determined that paper is present. Each sensor can detect that paper is set in the ASF. The above-described sensors make it possible to automatically detect the width of paper when paper is set. In this case, the user does not manually set the paper size. If the width of paper detected by the sensors corresponds to the width of a regular size, it can be determined that the paper of the regular size has been set.

Depending on the accuracy of the sensors, however, the set paper may not be identified as any one of a plurality of regular sizes having close paper widths. Improving the accuracy of sensors may increase cost. More specifically, it may be difficult to distinguish the plurality of regular sizes having close paper widths and automatically set the paper size. For example, when the user sets B5-size paper in the ASF, the sensors according to the present embodiment can recognize that the paper size is B5 based on the position of the slider in the paper width direction. However, when A4-size or letter-size paper is set in the ASF, the sensors can recognize that the paper size is not the B5 size but the A4 size or the letter size, but cannot recognize whether the paper size is the A4 size or the letter size.

In a case where the ASF is configured to measure the length of paper set in the ASF, the cost and the entire size of the printing apparatus will be increased due to addition of an extra sensor or enlargement of the ASF.

In a case where the paper feed port 114 is a cassette provided with a paper setting slider in the length direction (paper length direction slider), the paper size can be automatically recognized by a sensor provided in the paper length direction slider. In this case, however, the cost will be increased due to the sensor to be provided in the paper length direction slider in addition to the sensor for the paper width direction slider. If an extra sensor is added, the size of the cassette is increased, and as a result, the size of the printing apparatus is increased.

By a certain method, the A4 size or the letter size can be set as an initial value of a paper size by use of a destination setting (for example, Japan, North America, South America, and Europe) of the printing apparatus. However, some users suitably use A4-size and letter-size paper for different purposes. Both of the A4 size and the letter size are used in some areas such as South America. Therefore, the initial value of the paper size cannot be fixed based on the destination setting of the printing apparatus.

For this reason, according to the present embodiment, when a sensor detects that A4-size or letter-size paper has been set, paper size identification information is stored in the RAM 103 as information for identifying the paper size to be registered. More specifically, when a sensor detects that paper of one of the paper sizes (A4 and Letter) recognized to have the same paper width has been set, the paper size indicated by the paper size identification information is registered as the paper size of the paper. Specifically, the paper size identification information indicates one of the A4 size, the letter size, and UNSET. The paper size identification information "UNSET" indicates a state where the paper size is unidentifiable even if A4-size or letter-size paper is set. Therefore, according to the present embodiment, in a case where the paper size identification information indicates "UNSET" when a sensor detects that A4-size or letter-size paper has been set, a screen for setting the paper size identification information is displayed on the display operation unit 108. This screen prompts the user to set the A4 size or the letter size as the paper size identification information.

A universal serial bus (USB) function control unit 115 performs communication control on a USB interface and performs protocol control according to the USB communication standard. The universal USB function control unit 115 converts data from a USB function control task executed by the CPU 101 into a packet and transmits a USB packet to a personal computer (PC) (not illustrated). Also, the universal USB function control unit 115 converts a USB packet received from a PC into data and transmits the data to the CPU 101. A wide local area network (WLAN) unit 116 communicates with a terminal on a network (network capable of performing TCP/IP-based communication) via wireless communication. The WLAN unit 116 is assumed to be capable of performing data (packet) communication with an access point (AP) and a PC (not illustrated), for example, in a WLAN system conforming to the IEEE 802.11 series. The above-described components 101 to 106 and 108 to 116 are mutually connected via a CPU bus 121 managed by the CPU 101.

FIG. 2 is a flowchart illustrating a flow of processing to be performed when the MFP 100 according to the present embodiment is activated. The term "Delivery time" according to the present embodiment unit may mean the first activation of the MFP 100.

In step S201, when the user presses a power button on the display operation unit 108, the CPU 101 activates the MFP 100 (Soft-ON). In step S202, the CPU 101 refers to "Information about delivery time" stored in the RAM 103 to determine whether the present activation time is the delivery time. As "Information about delivery time", information indicating "Delivery time" is prestored in the RAM 103 at the time of manufacture and shipment of the MFP 100. Therefore, for example, when the MFP 100 is activated for the first time after the purchase, the CPU 101 determines that the present activation time is the delivery time (YES in step S202), and the processing proceeds to step S203. On the other hand, when the CPU 101 determines that the present activation time is not the delivery time (NO in step S202), the processing in the flowchart illustrated in FIG. 2 ends.

In step S203, the CPU 101 performs predetermined delivery time initial settings including language setting, ink tank attachment, printer information transmission permission, and fax setting. In step S203, the CPU 101 sets "UNSET" as the paper size identification information.

In step S204, the CPU 101 performs delivery time registration adjustment by using A4-size or letter-size paper to adjust a position of a print head and adjust the deviation of an ink impact position in the horizontal and vertical directions on paper. In particular, the CPU 101 performs the delivery time registration adjustment to improve the printing of drawings, lines, and texts. More specifically, in step S204, the CPU 101 prints a test pattern indicating the current ink impact position on A4-size or letter-size paper. Then, the timing of ink discharge from the print head is corrected according to a value specified by the user based on the printed test pattern or a value automatically determined by the MFP 100 by reading the test pattern. More specifically, the test pattern is printed when the MFP 100 is activated for the first time.

When the above-described test pattern is printed in step S204, the CPU 101 measures a feeding amount of the paper to determine whether the paper used for printing the test pattern is A4-size or letter-size paper. More specifically, the MFP 100 is provided with a sensor for detecting a length of paper in a paper conveyance direction, at a predetermined position on a conveyance path along which paper is conveyed by the recording unit 113. The CPU 101 determines whether the length of paper along the paper conveyance direction obtained as a result of detection by the sensor corresponds to the length of the A4-size paper or the length of the letter-size paper. This sensor will be described below with reference to FIGS. 5 to 8A, 8B, and 8C. The above-described determination is performed not by adding a special sensor but by using an existing mechanism of the MFP 100.

In step S205, the CPU 101 determines whether the paper size used for printing the test pattern during the delivery time registration adjustment has been identified. In a case where the paper size has been identified as the A4 size or the letter size (YES in step S205), the processing proceeds to step S206. In step S206, the CPU 101 updates the paper size identification information from "UNSET" to the size identified in step S205.

On the other hand, in a case where the paper size has not been identified as the A4 size or the letter size (NO in step S205), the processing proceeds to step S207. For example, the CPU 101 determines whether the paper length detected in step S204 corresponds to the length of the A4-size paper or the length of the letter-size paper. In a case where the detected paper length corresponds to neither the length of the A4-size paper nor the length of the letter-size paper (for example, there is an error exceeding a predetermined value), the CPU 101 determines that the paper size has not been identified as either the A4 size or the letter size in step S205. Also, when the user cancels the delivery time registration adjustment by pressing the cancellation key on the display operation unit 108, the CPU 101 determines that the paper size has not been identified as either the A4 size or the letter size in step S205.

In step S207, to connect with an external apparatus such as a PC (not illustrated), the CPU 101 performs network setting of the MFP 100, such as wireless network connection using the WLAN unit 116 and USB connection using the USB function control unit 115. In step S208, the CPU 101 updates "Information about delivery time" stored in the RAM 103 to "delivered" and ends the delivery time processing. As a result of updating the information in step S208, the CPU 101 determines that the present activation time is not the delivery time (NO in step S202) when the MFP 100 is activated next time. In this case, the processing in steps S203 to S208 is not performed.

In the processing illustrated in FIG. 2, the A4 size or the letter size is stored as the paper size identification information based on the paper size of the paper to be used for printing to be performed when the MFP 100 is activated for the first time (delivery time). Therefore, the user of the MFP 100 can store the paper size of the actually used paper as the paper size identification information in an early stage.

The registration adjustment and the paper size determination are performed in the above-described test pattern printing. Therefore, the A4 size or the letter size can be stored as the paper size identification information even if printing for the paper size determination is not performed separately from printing for the registration adjustment.

In a case where a printing apparatus does not have a delivery time registration adjustment function, the steps S204, 205, and 206 can be skipped. In this case, the CPU 101 ends the delivery time processing while "UNSET" is set as the paper size identification information. Also, in a case where the delivery time registration adjustment in step S204 is canceled, the CPU 101 ends the delivery time processing while "UNSET" is set as the paper size identification information. A method for setting the paper size identification information in these cases will be described below with reference to FIG. 3.

FIG. 3 is a flowchart illustrating a flow of processing to be performed when paper is set in the MFP 100 according to the present embodiment. When the sensor of the paper feed port 114 detects that paper has been set in the paper feed port 114, the CPU 101 starts the processing of the flowchart illustrated in FIG. 3.

In step S301, the CPU 101 refers to "Information about delivery time" stored in the RAM 103 to determine whether the present activation time is the delivery time. In a case where the present activation time is the delivery time (YES in step S301), the CPU 101 ends the processing to be performed when the paper is set as illustrated in FIG. 3 so that the processing described in FIG. 2 is prioritized.

On the other hand, in a case where the present activation time is not the delivery time (NO in step S301), the processing proceeds to step S302. In step S302, based on the width of paper set in the paper feed port 114 as a result of the detection by the sensor of the paper feed port 114, the CPU 101 determines whether a single regular size is identifiable as the size of the paper. For example, when the paper width direction slider of the paper feed port 114 is set to the B5 size, the CPU 101 determines that a single regular size is identifiable based on paper width information (YES in step S302), and the processing proceeds to step S303. In step S303, the CPU 101 registers the paper size (B5 size) identified based on the information about the paper width detected by the sensor to "Paper size information for paper feed port 114".

On the other hand, in a case where the paper width direction slider of the paper feed port 114 is set to the A4 size or the letter size, a plurality of regular sizes is identified based on the paper width information. In this case, the CPU 101 determines that a single regular size is unidentifiable (NO in step S302), and the processing proceeds to step S304. In step S304, the CPU 101 determines whether the paper size identification information is "UNSET". In a case where the CPU 101 determines that the paper size identification information is "UNSET" (YES in step S304), the processing proceeds to step S305. In step S305, the CPU 101 displays a screen for prompting the user to select either the A4-size paper or the letter-size paper as the paper that has been set in the paper feed port 114, on the display operation unit 108. The screen displayed in step S305 will be described below with reference to FIG. 4. Then, the CPU 101 sets the A4 size or the letter size selected by the user to the paper size identification information. In step S306, the CPU 101 registers the paper size identification information set in step S305 as "Paper size information for paper feed port 114".

On the other hand, in a case where the CPU 101 determines that the A4 size or the letter size has been set as the paper size identification information (NO in step S304), the processing skips step S305 and proceeds to step S306. More specifically, the preset paper size identification information is registered as "Paper size information for paper feed port 114".

Figure 4:
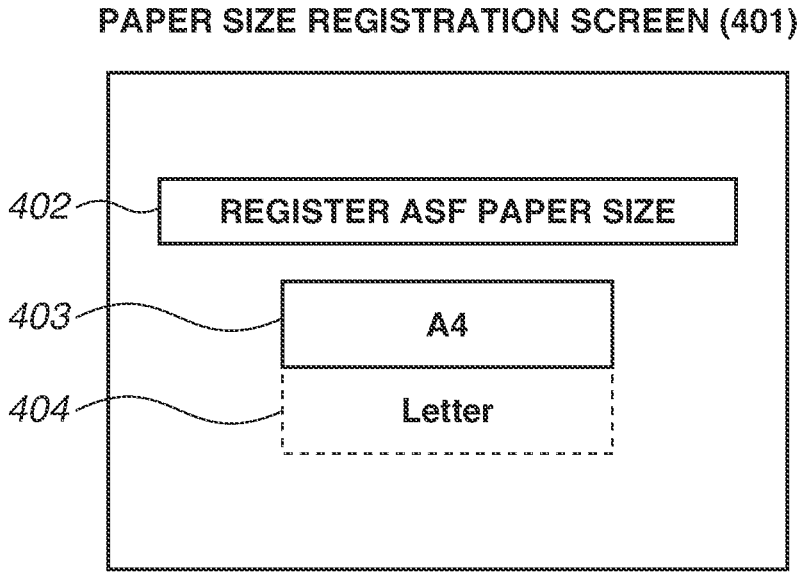
FIG. 4 illustrates an example of a screen for registering a paper size for an auto sheet feeder (ASF).

FIG. 4 illustrates an example of a screen for registering a paper size for the ASF displayed in step S305. The paper size registration screen 401 is displayed on the display operation unit 108 in step S305. A screen title 402 indicates that a paper size is to be registered. The user performs an operation for selecting A4 (403) or Letter (404) as the paper size. The paper size enclosed in solid lines is currently selected. The example illustrated in FIG. 4 indicates a state where the user selects the A4 size as the paper size. Therefore, the A4 size is set as the paper size identification information, and the A4 size is registered as "Paper size information about paper feed port 114". Based on the destination setting of the MFP 100, the CPU 101 determines one of the two sizes is to be selected (enclosed in solid lines) as the initial value when this screen is displayed for the first time in step S305.

Although, in the present embodiment, the paper registration screen is displayed in step S305 only when the paper size identification information is "UNSET", the present disclosure is not limited thereto. For example, by using the display operation unit 108, the screen illustrated in FIG. 4 may be displayed from a printer setting menu at an arbitrary timing. The paper size identification information may be changed, for example, when the user once sets the A4-size paper but wants to use letter-size paper.

As illustrated in FIG. 3, when A4-size or letter-size paper is set in the paper feed port 114, the paper size of the paper used in the registration adjustment illustrated in FIG. 2 at the delivery time is automatically registered as "Paper size information for paper feed port 114". Even when the registration adjustment is not performed and the paper size identification information is "UNSET", the user can register the A4 size or the letter size as "Paper size information for paper feed port 114" in the screen illustrated in FIG. 4.

The paper set in the paper feed port 114 is to be conveyed and printed according to a printing instruction from an external apparatus or the display operation unit 108. According to the processing illustrated in FIG. 3, the paper size of the paper can be set in step S303 or S306 before the paper set in the paper feed port 114 is conveyed and printed. For this reason, since the size of paper can be registered without conveying the paper, the paper currently set in the paper feed port 114 can be registered.

A method for detecting the paper size when the test pattern is printed in the registration adjustment will be described below with reference to FIGS. 5 to 8A, 8B, and 8C.

Figure 5:
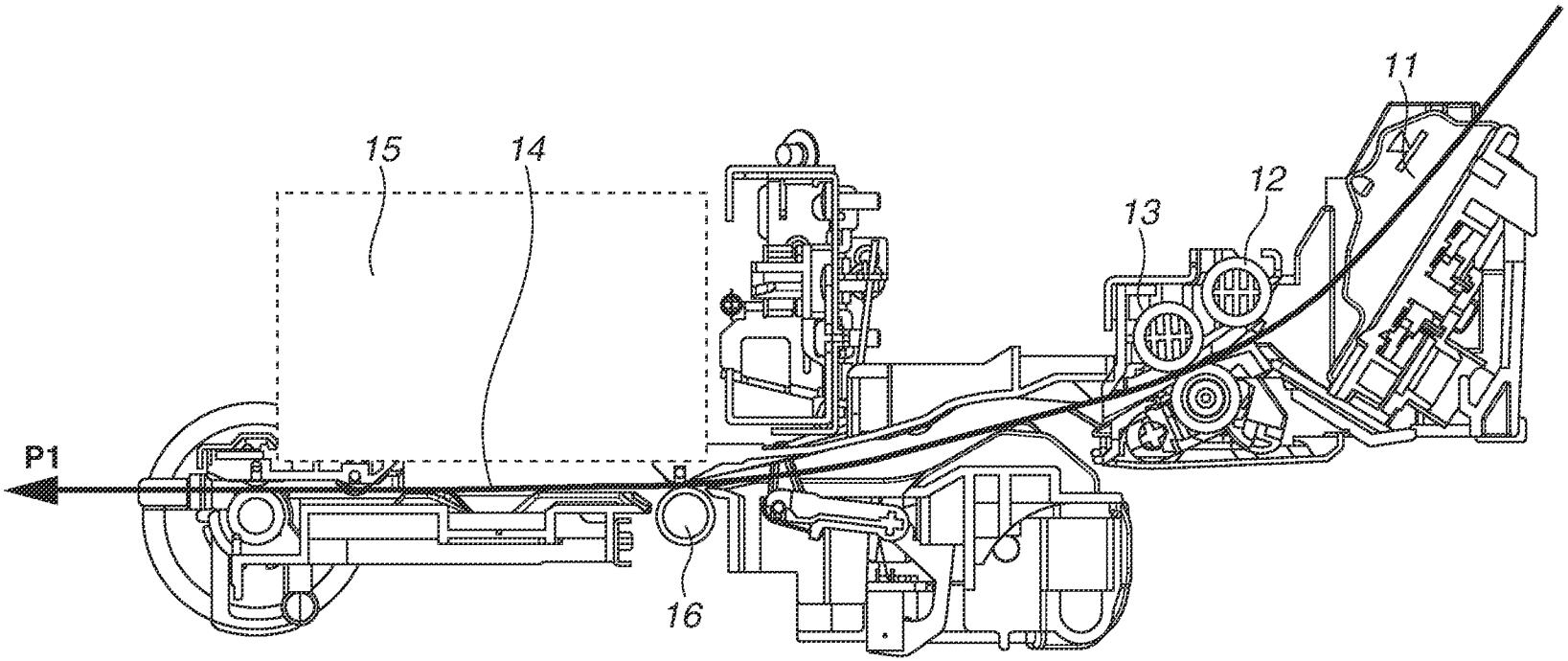
FIG. 5 is a vertical cross-sectional view illustrating the MFP according to the present embodiment.

FIG. 5 is a vertical cross-sectional view illustrating the MFP 100 according to the present embodiment. The paper feed port 114 includes a sheet stacking unit 11, a paper feed unit 12, and a separation unit 13. The recording unit 113 includes a horizontal conveyance unit 14. FIG. 5 illustrates a paper flow P1. In the above-described configuration, one sheet is separated from a paper sheet bundle set in the sheet stacking unit 11 and then sent to the horizontal conveyance unit 14 by the paper feed unit 12 and the separation unit 13. The sheet P passes through an image formation unit 15 and then is discharged. The image formation unit (image processing unit) 15 is included in the recording unit 113. The conveyance roller 16 as a conveyance unit for conveying paper with high accuracy is disposed in the horizontal conveyance unit 14. The conveyance roller 16 is connected with a drive motor as a drive source (not illustrated). An amount of rotation of the conveyance roller 16 is controlled by an encoder wheel and an encoder sensor coaxially attached with the conveyance roller 16. This configuration allows the paper conveyance with a resolution of 7200 dots per inch (dpi) (0.0035 mm/slit).

Figure 6:
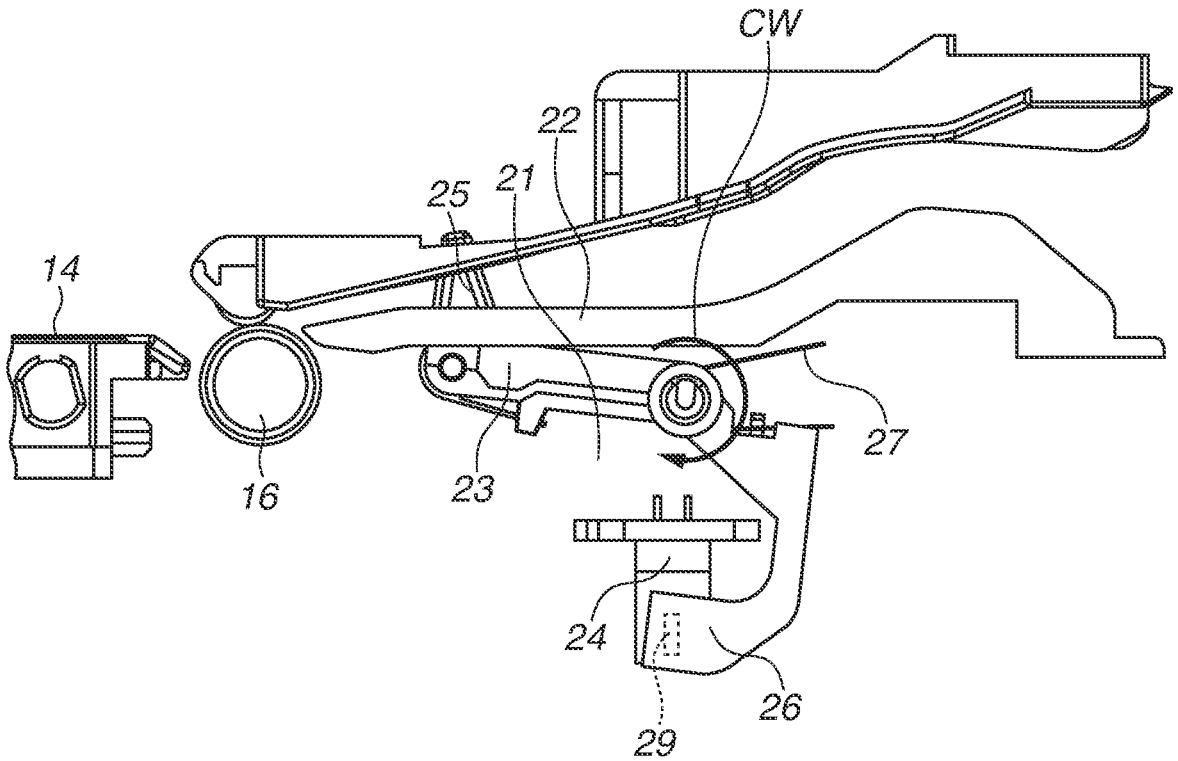
FIG. 6 is a vertical cross-sectional view illustrating a paper detection method performed by the MFP according to the present embodiment.
Figure 7A:
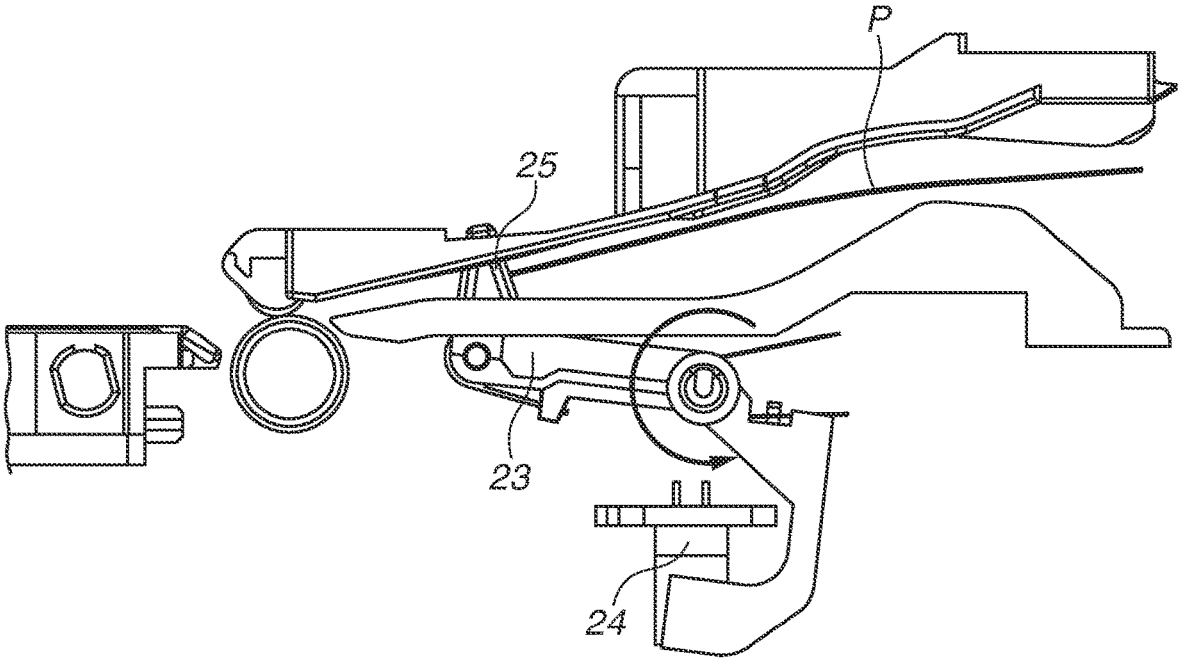
FIGS. 7A and 7B are vertical cross-sectional views illustrating a method for identifying a leading edge of paper performed by the MFP according to the present embodiment.
Figure 7B:
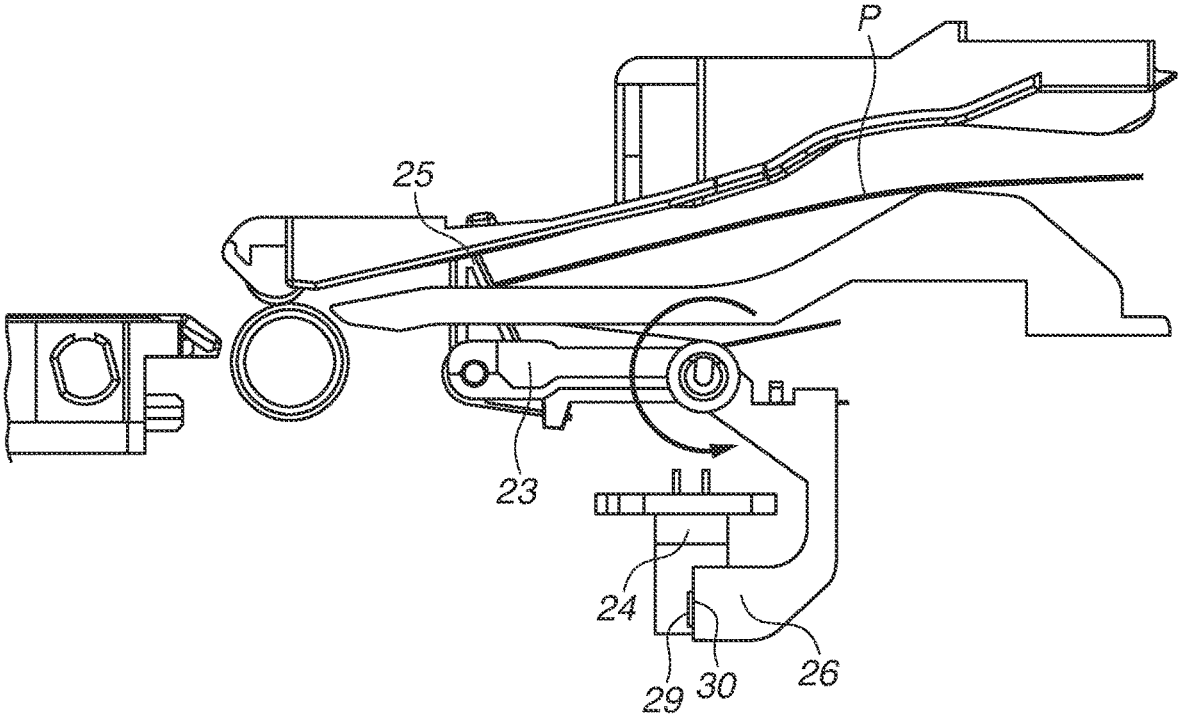

FIG. 6 is a vertical cross-sectional view illustrating a paper detection method to be performed by the MFP 100 according to the present embodiment. A paper edge detection unit 21 for detecting the leading or trailing edge of paper is attached in the conveyance path on the upstream side of the conveyance roller 16 of the horizontal conveyance unit 14. The paper edge detection unit 21 includes a detection lever 23 and an optical sensor 24 rockably attached to the lower side of a guide surface 22 under the conveyance path. One end 25 of the detection lever 23 contacts paper, and the other end 26 thereof intercepts an optical axis of the optical sensor 24. Although the detection lever 23 is urged in the clockwise (CW) direction by a spring 27, as illustrated in FIG. 6, the position of the detection lever 23 is latched by a stopper (not illustrated) when the detection lever 23 is not in contact with the paper. At this position of the detection lever 23, the optical axis 29 of the optical sensor 24 is intercepted and therefore the optical sensor 24 is OFF. When the detection lever 23 is in contact with the paper, as illustrated in FIGS. 7A and 7B (described below), the detection lever 23 rotates in the rotational direction against the urging force, as illustrated in FIGS. 7A and 7B. The optical axis 29 of the optical sensor 24 is not intercepted and therefore the optical sensor 24 is ON.

FIGS. 7A and 7B are vertical cross-sectional views illustrating a method for identifying the leading edge of paper performed by the MFP 100 according to the present embodiment. A paper detection method using the above-described detection unit will be described below with reference to FIGS. 7A and 7B. The leading edge of a sheet P comes in contact with the end 25 of the detection lever 23. In this state, the optical sensor 24 is OFF (FIG. 7A). When the sheet P is further conveyed, the detection lever 23 starts rocking in the counterclockwise (CCW) direction. When the leading edge of the sheet P reaches a sheet leading edge detection position, an edge 30 of the other end 26 of the detection lever 23 passes across an optical axis 29, and the optical sensor 24 is turned ON from being OFF (FIG. 7B). Then, the CPU 101 detects that the leading edge of the sheet P has reached the paper leading edge detection position and controls the conveyance amount of the sheet P, for example, recognizing the position as the starting point. When the sheet P is further conveyed, then the detection lever 23 further rocks, the edge 30 is retracted from the optical axis 29, and the optical sensor 24 is kept ON.

Figure 8A:
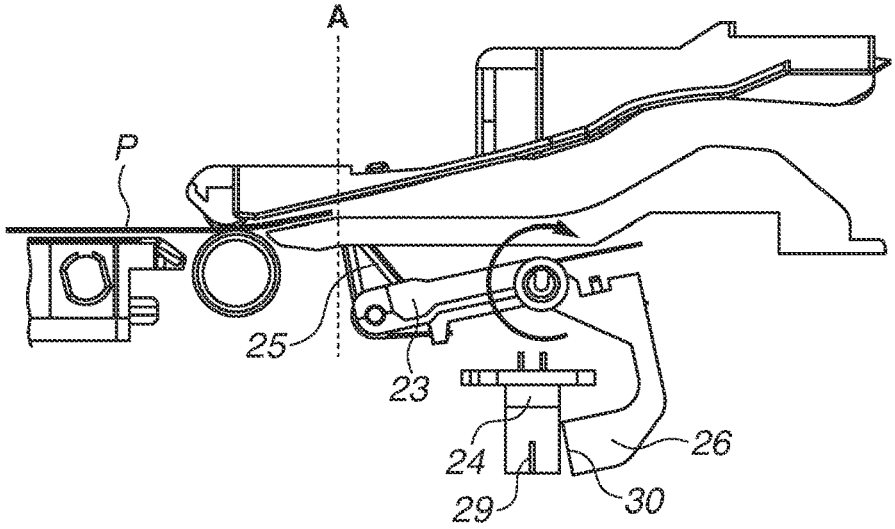
FIGS. 8A, 8B, and 8C are vertical cross-sectional views illustrating a method for identifying a trailing edge of paper performed by the MFP according to the present embodiment.
Figure 8B:
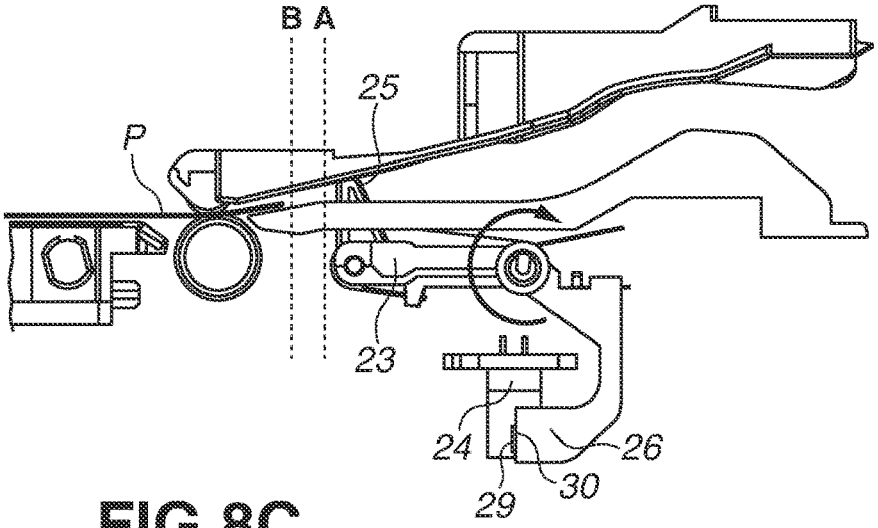
Figure 8C:
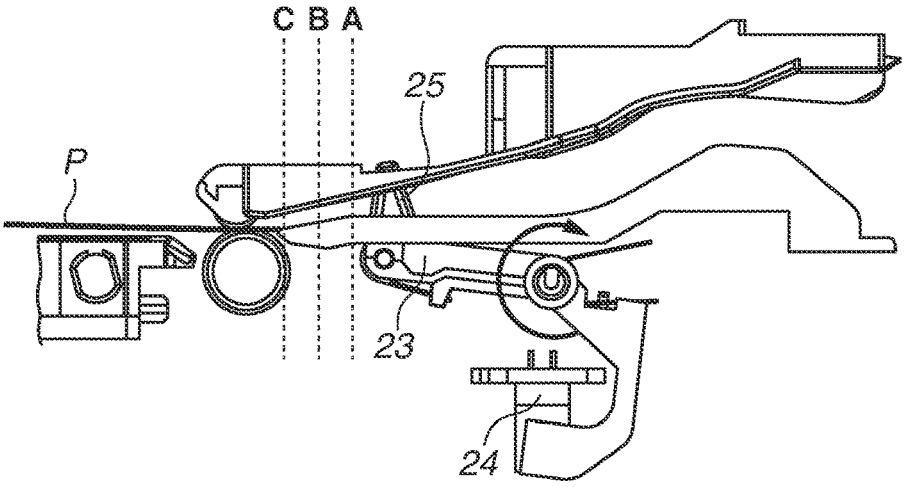

FIGS. 8A, 8B, and 8C are vertical cross-sectional views illustrating a method for identifying the trailing edge of the sheet P performed by the MFP 100 according to the present embodiment. A method for grasping the paper length by using the detection lever 23 and the optical sensor 24 will be described below with reference to FIGS. 8A, 8B, and 8C. Referring to FIGS. 8A, 8B, and 8C, when the trailing edge of the sheet P reaches a sheet trailing edge detection position A, the detection lever 23 separates from the trailing edge of the sheet P and starts rotating in the clockwise (CW) direction by an urging force (FIG. 8A). When the detection lever 23 rotates, the edge 30 passes across the optical axis 29 and therefore the optical sensor 24 is turned OFF from being ON (FIG. 8B). A required time period after the detection lever 23 starts rocking until the optical sensor 24 is turned OFF from being ON is about 0.02 seconds according to the present embodiment. This time period is referred to as a delay time Ts. During the delay time Ts, the trailing edge of the sheet P advances from the sheet trailing edge detection position A to a position B. Therefore, in order to detect that the trailing edge of the sheet P has passed through the position A, it is necessary to determine that the trailing edge of the sheet P is detected at a time traced back by the delay time Ts from the time when the optical sensor 24 being OFF is detected. The detection lever 23 continues rocking and then is latched and stopped by the above-described stopper (FIG. 8C). At this timing, the trailing edge of the sheet P has further advanced and reached a position C. The delay time Ts is stored in a rewritable storage unit. To correct variation for each apparatus, the MFP 100 includes a delay time correction unit (described below) for correcting variation for each apparatus. In sheet trailing edge detection, the CPU 101 can grasp the paper length by obtaining the conveyance amount during the time period after the time when the leading edge of the sheet P comes into contact with the above-described conveyance roller 16 till the time when the trailing edge thereof reaches the trailing edge detection position A. In this way, the CPU 101 can determine the length, in the conveyance direction, of the paper being currently conveyed.

The sensor for determining the length of paper on the conveyance path described above with reference to FIGS. 5 to 8A, 8B, and 8C is also used for other purposes in addition to the paper size determination in step S204 illustrated in FIG. 2. For example, the CPU 101 determines the length of the paper currently being conveyed at the time of the regular image printing. In a case where the determined length is shorter than the length of an image, the CPU 101 may perform processing not to print an image portion that lies off the paper. This processing can prevent useless ink consumption due to printing of the image portion that lies off the paper. According to the present embodiment, the sensor described above with reference to FIGS. 5 to 8A, 8B, and 8C is used for the paper size determination in step S204 illustrated in FIG. 2 and other purposes. This eliminates the need of disposing a special sensor for the paper size determination in step S204 illustrated in FIG. 2, making it possible to prevent a cost increase.

As described above, according to the present embodiment, the CPU 101 identifies the A4 size or the letter size by measuring the feeding amount of the paper used in the delivery time registration adjustment. For example, when the delivery time registration adjustment is not performed or the registration adjustment is canceled, the CPU 101 prompts the user to select A4 or Letter on a display screen when paper is set in the paper feed port 114 for the first time. The sensor of the paper feed port 114 makes it possible to identify a plurality of paper sizes which is recognized to have the same paper width. As a result, a user can save work and time for registering a paper size each time the user sets paper in the paper feed port 114.

Although, in the above-described embodiment, an ASF is used as the paper feed port 114, the present disclosure is not limited thereto. Even if a paper cassette without a sensor disposed in the length direction is used, it is effective to measure the feeding amount of the paper used in the delivery time registration adjustment.

Although, in the above-described embodiment, the CPU 101 measures the feeding amount of the paper used in the delivery time registration adjustment, the present disclosure is not limited thereto. Examples of timings other than the delivery time include the timing of paper feeding when the paper size identification information is "UNSET" and the timing of first paper feeding after initialization, for example, after the MFP 100 is reset from the display operation unit 108. Paper may be fed for the purpose of other than the registration adjustment, for example, printing operations for the maintenance of the MFP 100, such as nozzle check printing and ink wipe cleaning from the display operation unit 108 or a PC, and regular printing operations such as printing from a PC and a copy operation with a single MFP 100.

Although, in the above-described embodiment, the paper size is measured based on the feeding amount of the paper and the user is prompted to manually register the paper size in the screen illustrated in FIG. 4 only when the paper size identification information is "UNSET", the present disclosure is not limited thereto. For example, when performing printing in a state where "A4" is set as the paper size identification information, if the paper size is determined to be "Letter" based on the sensor of the paper feed port 114 and the feeding amount of the paper, the paper size identification information may be automatically updated to "Letter". Alternatively, the user may be prompted to set the paper size in the screen illustrated in FIG. 4 after printing.

The paper size registered for the paper feed port 114 in step S303 or S306 may be used for various purposes. For example, the paper size may be used for the standard printing system of the OS. In the standard printing system, a terminal apparatus such as a smart phone, tablet, and PC instructs a printing apparatus to perform printing based on a communication protocol for allowing printing without using a printer driver. In this standard printing system of the OS, the paper size registered in step S303 or S306 may be displayed on the terminal apparatus which issues a printing instruction. More specifically, before a print job is transmitted from the terminal apparatus, for example, when the terminal apparatus and the WLAN unit 116 are connected, the paper size registered in step S303 or S306 is transmitted from printing apparatus to the terminal apparatus via the WLAN unit 116. Then, the terminal apparatus displays the paper size received from the printing apparatus and registered in step S303 or S306. The paper size is determined as a print setting for the print job to be transmitted by the terminal apparatus. For example, when a plurality of paper feed ports is included in the MFP 100, a paper size is registered for each of the plurality of paper feed ports in step S303 or S306. Then, the terminal apparatus is notified of the plurality of paper sizes registered for the plurality of paper feed ports, and accordingly the terminal apparatus displays the plurality of paper feed ports and the paper size registered for each of the plurality of paper feed ports. Then, when the user selects a paper feed port to which a desired paper size is registered on a screen of the terminal apparatus, the paper size is automatically set as a print setting.

The paper size registered for the paper feed port 114 in step S303 or S306 may be used for the matching processing in the MFP 100. More specifically, the MFP 100 analyzes print settings included in the print job received from the terminal apparatus to acquire the paper size as a print setting. Then, the MFP 100 compares the paper size set as a print setting with the paper size registered in step S303 or S306 and, when the two paper sizes are matched, prints the image included in the above-described print job. On the other hand, when the two paper sizes are mismatched, the MFP 100 displays an error on the display operation unit 108.

The paper size registered for the paper feed port 114 in step S303 or S306 may be set as a print setting when the user performs printing by an operation on the MFP 100. When the user selects a paper feed port when using built-in functions such as copy and card direct printing via the display operation unit 108, the paper size registered in step S303 or S306 is set as a print setting. As a result, the print setting is simplified.

Although, in the present embodiment, only the paper width out of the paper width and the paper length is detected by using the sensor of the paper feed port 114, a configuration for detecting only the paper length is also applicable. In this case, a sensor for detecting the paper width on the paper conveyance path is provided. This allows acquiring effects equivalent to the effects of the above-described embodiment.

The functions of the present embodiment can also be implemented with the following configuration. More specifically, a program code for implementing the processing of the present embodiment is supplied to a system or apparatus, and a computer (or CPU or micro processing unit (MPU)) of the system or apparatus executes the program code. In this case, the program code itself read from a storage medium will implement the above-described functions of the present embodiment, and the storage medium storing the program code will also implement the functions of the present embodiment.

The program code for implementing the functions of the present embodiment may be executed by either one computer (CPU or MPU) or a plurality of computers in a collaborated way. The program code may be executed by a computer, or hardware such as a circuit for implementing the functions of the program code may be provided. Alternatively, a part of the program code may be implemented by hardware, and the remaining portion may be executed by a computer.

Even in a case where a result of the detection for paper set in a paper feed port corresponds to a plurality of paper sizes, the paper size of the paper can be suitably registered.

OTHER EMBODIMENTS

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to embodiments, it is to be understood that the disclosure is not limited to the disclosed embodiments. The scope of the following claims is to be accorded the broadest interpretation so as to encompass all such modifications and equivalent structures and functions.

This application claims the benefit of Japanese Patent Application No. 2018-068250, filed Mar. 30, 2018, which is hereby incorporated by reference herein in its entirety.

What is claimed is:

1. A printing apparatus to print an image on paper set in a paper feed port, the printing apparatus comprising:

a conveyance unit configured to convey the paper set in the paper feed port in a predetermined conveyance direction;

a first detection unit configured to detect a first length, along the predetermined conveyance direction, of the conveyed paper;

a second detection unit configured to detect a second length, along a direction intersecting with the predetermined conveyance direction, of the paper set in the paper feed port, wherein paper to be set in the paper feed port includes a first paper and a second paper;

an identification unit configured to identify a regular size of the first paper from among a plurality of regular sizes, based on a first result of detection by the first detection unit on the conveyed first paper in printing of a predetermined test pattern;

a display unit configured to display a screen for selecting any one of the plurality of regular sizes in a case where the identification unit does not identify the regular size of the first paper as any one of the plurality of regular sizes and the second detection unit detects the second paper; and a registration unit configured to register a size corresponding to the first length and the second length of the paper set in the paper feed port, based on a second result of detection by the second detection unit, wherein the first detection unit detects the first length, in the predetermined conveyance direction, of the first paper conveyed to print the predetermined test pattern before the second paper is set in the paper feed port, wherein the registration unit registers the regular size identified by the identification unit based on the result of detection on the first paper by the first detection unit from among the plurality of regular sizes corresponding to the second detection result, and wherein, in the case where the identification unit does not identify the regular size of the first paper as any one of the plurality of regular sizes and the second detection unit detects the second paper, the registration unit registers, from among the plurality of regular sizes, a regular size selected by a user operation on the screen displayed by the display unit.

2. The printing apparatus according to claim 1, wherein, in a case where the second detection result corresponds to a single regular size, the registration unit registers the single regular size.

3. The printing apparatus according to claim 1, wherein, in a case where printing of the predetermined test pattern is canceled, the identification unit does not identify the regular size of the first paper as any one of the plurality of regular sizes.

4. The printing apparatus according to claim 1, wherein, in a case of printing of the predetermined test pattern where the detected first length of the conveyed first paper does not correspond to any of the plurality of regular sizes, the identification unit does not identify the regular size of the first paper as any one of the plurality of regular sizes.

5. The printing apparatus according to claim 1, further comprising a test pattern printing unit configured to instruct a recording unit of the printing apparatus to print the predetermined test pattern on a condition that the printing apparatus is activated for the first time, wherein, in printing by the test pattern printing unit, the identification unit identifies the regular size of the first paper as one of the plurality of regular sizes based on the first detection result.

6. The printing apparatus according to claim 1, further comprising an ink jet printer, wherein the printing apparatus is configured to receive input to adjust an ink impact position on the paper based on the predetermined test pattern printed by the ink jet printer and is configured to adjust the ink impact position on the paper based on the received input.

7. The printing apparatus according to claim 1, wherein, in a case where the second detection result corresponds to at least one of the plurality of regular sizes, the registration unit registers the regular size based on the first detection result before the conveyance unit conveys the second paper.

8. The printing apparatus according to claim 1, wherein the plurality of regular sizes includes an A4 size and a letter size.

9. The printing apparatus according to claim 1, further comprising a notification unit configured to notify a terminal apparatus of a regular size registered by the registration unit.

10. A method to control a printing apparatus to print an image on paper set in a paper feed port, the method comprising:

conveying the paper set in the paper feed port in a predetermined conveyance direction;

detecting, as a first detection, a first length, along the predetermined conveyance direction, of the conveyed paper;

detecting, as a second detection, a second length, along a direction intersecting with the predetermined conveyance direction, of the paper set in the paper feed port, wherein paper to be set in the paper feed port includes a first paper and a second paper;

identifying a regular size of the first paper from among a plurality of regular sizes, based on a first result of detection by the first detection on the conveyed first paper in printing of a predetermined test pattern; and registering a size corresponding to the first length and the second length of the paper set in the paper feed port, based on a second result of detection by the second detection, wherein the first detection detects the first length, in the predetermined conveyance direction, of the first paper conveyed to print the predetermined test pattern before the second paper is set in the paper feed port, wherein registering includes registering the regular size identified based on the result of detection on the first paper from among the plurality of regular sizes corresponding to the second detection result, and wherein, in a case identifying includes not identifying the regular size of the first paper as any one of the plurality of regular sizes, the second detection detects the second paper, and a regular size selected by a user operation from among the plurality of regular sizes is received, registering includes registering the received selected regular size.

11. A non-transitory computer-readable storage medium storing a program to cause a computer to perform a method to control a printing apparatus to print an image on paper set in a paper feed port, the method comprising:

conveying the paper set in the paper feed port in a predetermined conveyance direction;

detecting, as a first detection, a first length, along the predetermined conveyance direction, of the conveyed paper;

detecting, as a second detection, a second length, along a direction intersecting with the predetermined conveyance direction, of the paper set in the paper feed port, wherein paper to be set in the paper feed port includes a first paper and a second paper;

identifying a regular size of the first paper from among a plurality of regular sizes, based on a first result of detection by the first detection on the conveyed first paper in printing of a predetermined test pattern; and registering a size corresponding to the first length and the second length of the paper set in the paper feed port, based on a second result of detection by the second detection, wherein the first detection detects the first length, in the predetermined conveyance direction, of the first paper conveyed to print the predetermined test pattern before the second paper is set in the paper feed port, wherein registering includes registering the regular size identified based on the result of detection on the first paper from among the plurality of regular sizes corresponding to the second detection result, and wherein, in a case identifying includes not identifying the regular size of the first paper as any one of the plurality of regular sizes, the second detection detects the second paper, and a regular size selected by a user operation from among the plurality of regular sizes is received, registering includes registering the received selected regular size.

* * * * *